US008264375B2

(12) United States Patent
DeVries

(10) Patent No.: US 8,264,375 B2
(45) Date of Patent: Sep. 11, 2012

(54) METHOD AND SYSTEM FOR DEVELOPING TRAFFIC MESSAGES

(75) Inventor: Steven P. DeVries, Schereville, IN (US)

(73) Assignee: Navteq B.V., Veldhoven (NL)

( * ) Notice: Subject to any disclaimer, the term of this patent is extended or adjusted under 35 U.S.C. 154(b) by 530 days.

(21) Appl. No.: 12/630,054

(22) Filed: Dec. 3, 2009

(65) Prior Publication Data

US 2010/0188264 A1 Jul. 29, 2010

Related U.S. Application Data

(60) Provisional application No. 61/148,284, filed on Jan. 29, 2009.

(51) Int. Cl.
*G08G 1/09* (2006.01)

(52) U.S. Cl. ..... 340/905; 340/901

(58) Field of Classification Search ..... 340/905, 340/901

See application file for complete search history.

(56) References Cited

U.S. PATENT DOCUMENTS

| | | | | |
|---|---|---|---|---|
| 5,173,691 | A * | 12/1992 | Sumner | 340/905 |
| 6,438,561 | B1 | 8/2002 | Israni et al. | 707/104.1 |
| 6,842,620 | B2 | 1/2005 | Smith et al. | 455/456 |
| 6,879,907 | B2 * | 4/2005 | Feldman et al. | 701/117 |
| 6,989,765 | B2 | 1/2006 | Gueziec | 340/905 |
| 7,096,115 | B1 * | 8/2006 | Groth et al. | 701/117 |

* cited by examiner

*Primary Examiner* — Travis Hunnings
(74) *Attorney, Agent, or Firm* — Jon D. Shutter; Frank J. Kozak; Adil M. Musabji

(57) ABSTRACT

A computer implemented method of compressing a plurality of TPEG format traffic messages is provided. The method forms a template containing the data values of fields of a message management container, an event container and a location container and forms a global data set representing a base time of the traffic messages and data indicating the geographic region. The method creates compressed TPEG traffic messages comprising a template identification indicating the template and data values of the fields of the message management container, the event container and the location container not included in the template or global data set.

20 Claims, 8 Drawing Sheets

| 120 | | | | 122 | | | 124 | | | | | 130 | | | | 132 | | | 134 |
|---|---|---|---|---|---|---|---|---|---|---|---|---|---|---|---|---|---|---|---|
| TEC comp | | | | MESSAGE MANAGEMENT CONTAINER 112 | | | | | | | | | | | | | | | |
| header | | | | header | | | number | | Ver | sel | expiration time | | | | | generation time | | | pri |
| 00 | 2F | 00 | | 01 | 0E | 0D | 98 | 65 | 00 | 30 | 48 | D3 | 7D | 16 | 48 | D3 | 78 | 20 | 02 |
| 00 | 30 | 00 | | 01 | 0E | 0D | 97 | 71 | 07 | 30 | 48 | D3 | 7D | 16 | 48 | D3 | 4C | 4C | 02 |
| 00 | 29 | 00 | | 01 | 0E | 0D | 98 | 64 | 00 | 30 | 48 | D3 | 7D | 16 | 48 | D3 | 78 | 4A | 02 |
| 00 | 2A | 00 | | 01 | 0E | 0D | 98 | 61 | 00 | 30 | 48 | D3 | 7D | 16 | 48 | D3 | 77 | 6C | 02 |
| 00 | 29 | 00 | | 01 | 0E | 0D | 98 | 5E | 00 | 30 | 48 | D3 | 7D | 16 | 48 | D3 | 67 | 51 | 02 |
| 00 | 29 | 00 | | 01 | 0E | 0D | 98 | 4F | 00 | 30 | 48 | D3 | 7D | 16 | 48 | D3 | 72 | 51 | 02 |
| 00 | 29 | 00 | | 01 | 0E | 0D | 98 | 49 | 00 | 30 | 48 | D3 | 7D | 16 | 48 | D3 | 70 | C8 | 02 |
| 00 | 2A | 00 | | 01 | 0E | 0D | 98 | 24 | 04 | 30 | 48 | D3 | 7D | 16 | 48 | D3 | 64 | 34 | 02 |
| 00 | 29 | 00 | | 01 | 0E | 0D | 98 | 4A | 00 | 30 | 49 | D3 | 7D | 16 | 48 | D3 | 72 | 44 | 02 |
| 00 | 30 | 00 | | 01 | 0E | 0D | 98 | 44 | 02 | 30 | 48 | D3 | 7D | 16 | 48 | D3 | 71 | CC | 01 |
| | | | | | | | | | 126 | 128 | | | | | | | | | |

FIG. 5a

| 136 | | | 138 | 140 | 142 | | | | 144 | | | | 146 | | | 148 | 150 | 152 | 154 | 156 | | | 158 | 160 | 162 | 164 |
|---|---|---|---|---|---|---|---|---|---|---|---|---|---|---|---|---|---|---|---|---|---|---|---|---|---|---|
| EVENT CONTAINER 114 | | | | | | | | | | | | | | | | | | | | | | | | | | |
| header | | | Eff | Sel | Start time | | | | Stop time | | | | header | | | cod | wl | sel | sub | header | | | cod | wl | sel | lan |
| 03 | 0F | 02 | 07 | 00 | | | | | | | | | 04 | 04 | 03 | 0A | 02 | 00 | | 04 | 04 | 03 | 01 | 02 | 00 | |
| 03 | 10 | 02 | 01 | 00 | | | | | | | | | 04 | 04 | 03 | 0A | 02 | 00 | | 04 | 05 | 04 | 04 | 01 | 08 | 03 |
| 03 | 09 | 02 | 01 | 00 | | | | | | | | | 04 | 04 | 03 | 0A | 02 | 00 | | | | | | | | |
| 03 | 0A | 02 | 01 | 00 | | | | | | | | | 04 | 05 | 04 | 02 | 02 | 20 | 07 | | | | | | | |
| 03 | 09 | 02 | 06 | 00 | | | | | | | | | 04 | 04 | 03 | 01 | 02 | 00 | | | | | | | | |
| 03 | 09 | 02 | 01 | 00 | | | | | | | | | 04 | 04 | 03 | 0A | 02 | 00 | | | | | | | | |
| 03 | 09 | 02 | 01 | 00 | | | | | | | | | 04 | 04 | 03 | 0A | 02 | 00 | | | | | | | | |
| 03 | 0A | 02 | 01 | 00 | | | | | | | | | 04 | 05 | 04 | 06 | 02 | 20 | 07 | | | | | | | |
| 03 | 09 | 02 | 01 | 00 | | | | | | | | | 04 | 04 | 03 | 0B | 02 | 00 | | | | | | | | |
| 03 | 11 | 0A | 07 | 60 | 48 | D3 | 5C | 00 | 48 | D7 | 0A | 30 | 04 | 04 | 03 | 03 | 01 | 00 | | | | | | | | |

FIG. 5b 166 168 170 172 174 176 178 180

| LOCATION REFERENCE CONTAINER | | | | | | | | | | | | |
|---|---|---|---|---|---|---|---|---|---|---|---|---|
| LRC | | | TLR | | | TMC ID | | cc | ltn | sel | ext | ver |
| 02 | 0B | 00 | 02 | 08 | 07 | 80 | 4F | 0D | 01 | 54 | 01 | 30 |
| 02 | 0B | 00 | 02 | 08 | 07 | 2B | 63 | 0D | 01 | 54 | 01 | 30 |
| 02 | 0B | 00 | 02 | 08 | 07 | 2A | 84 | 0D | 01 | 54 | 03 | 30 |
| 02 | 0B | 00 | 02 | 08 | 07 | 27 | 76 | 0D | 01 | 14 | 02 | 30 |
| 02 | 0B | 00 | 02 | 08 | 07 | 29 | A9 | 0D | 01 | 54 | 01 | 30 |
| 02 | 0B | 00 | 02 | 08 | 07 | 27 | 2F | 0D | 01 | 54 | 01 | 30 |
| 02 | 0B | 00 | 02 | 08 | 07 | 2C | F4 | 0D | 01 | 54 | 09 | 30 |
| 02 | 0B | 00 | 02 | 08 | 07 | A5 | FA | 0D | 01 | 14 | 01 | 30 |
| 02 | 0B | 00 | 02 | 08 | 07 | 30 | CB | 0D | 01 | 74 | 02 | 30 |
| 02 | 0A | 00 | 02 | 07 | 06 | 2C | AD | 0D | 01 | 64 | | 30 |

FIG. 5c

| Compressed Global Information 254 | | | | | | |
|---|---|---|---|---|---|---|
| Country code 172 | Ltn 174 | Version 180 | Base time 256 | | | |
| 13 | 01 | 30 | 48 | D3 | 7D | 16 |

252 164

| COMPRESSED TPEG Messages 250 | | | | | | | | | | | | | | | | | | | | | |
|---|---|---|---|---|---|---|---|---|---|---|---|---|---|---|---|---|---|---|---|---|---|
| MMC Container 258 | | | | | | EVENT Container 262 | | | | | | | | 160 | | | LOCATION Container 264 | | | | |
| ID | Number 124 | | Ver 126 | Time 260 | | Eff 138 | Start 142 | | Stop 144 | | Cod 148 | Wl 150 | Sub 154 | cod 158 | wl | lan | TMC ID | | Ext | Sel |
| 01 | 98 | 65 | 00 | 00 | 00 | 07 | | | | | 0A | 02 | | 01 | 02 | | 80 | 4F | 01 | 01 |
| 02 | 97 | 71 | 07 | 00 | 00 | 01 | | | | | 0A | 02 | | 04 | 01 | 03 | 2B | 63 | 01 | 01 |
| 03 | 98 | 64 | 00 | 00 | 00 | 01 | | | | | 0A | 02 | | | | | 2A | 84 | 03 | 01 |
| 04 | 98 | 61 | 00 | 00 | 00 | 01 | | | | | 02 | 02 | 07 | | | | 27 | 76 | 02 | 00 |
| 03 | 98 | 5E | 00 | 00 | 00 | 06 | | | | | 01 | 02 | | | | | 29 | A9 | 01 | 01 |
| 03 | 98 | 4F | 00 | 00 | 00 | 01 | | | | | 0A | 02 | | | | | 27 | 2F | 01 | 01 |
| 03 | 98 | 49 | 00 | 00 | 00 | 01 | | | | | 0A | 02 | | | | | 2C | F4 | 09 | 01 |
| 04 | 98 | 24 | 04 | 00 | 00 | 01 | | | | | 06 | 02 | 07 | | | | A5 | FA | 01 | 00 |
| 03 | 98 | 4A | 00 | 00 | 00 | 01 | | | | | 0B | 02 | | | | | 30 | CB | 02 | 02 |
| 05 | 98 | 44 | 02 | 00 | 00 | 07 | 00 | 00 | FF | FF | 03 | 01 | | | | | 2C | AD | | 02 |

170 178 266

FIG. 7

METHOD AND SYSTEM FOR DEVELOPING TRAFFIC MESSAGES

REFERENCE TO RELATED APPLICATIONS

This application claims the benefit of U.S. Provisional Patent Application No. 61/148,284 filed Jan. 29, 2009 and entitled "METHOD AND SYSTEM FOR DEVELOPING TRAFFIC MESSAGES." The full disclosure of U.S. Provisional Patent Application Ser. No. 61/148,284 is incorporated herein by reference.

BACKGROUND OF THE INVENTION

The present invention relates to a method and system for developing traffic messages for broadcast, and more particularly to a method and system for compressing the data size of the traffic messages.

In some areas, systems broadcast data messages that contain up-to-the-minute reports of traffic and road condition information. These systems broadcast the traffic data over traffic message channels on a continuous, periodic, or frequently occurring basis. Traffic message receivers decode the data and provide up-to-the-minute reports of traffic and road conditions.

These traffic broadcast systems have several advantages over radio stations that simply broadcast audio traffic reports. For example, with the traffic broadcasting systems, a driver can obtain the traffic information quickly. The driver does not have to wait until the radio station broadcasts a traffic report. Another advantage of the traffic broadcast systems is that the driver does not have to listen to descriptions of traffic conditions for areas remote from his or her location. Another advantage of the traffic broadcast systems is that more detailed and possibly more up-to-date information can be provided.

One protocol for broadcasting traffic messages is the Traffic Message Channel (TMC), which is used in Europe, North America and elsewhere. In Europe TMC is broadcast as part of the Radio Data System (RDS) and North America TMC is broadcast as part of the Radio Broadcast Data System (RBDS). Essentially RDS and RBDS are identical. Another traffic broadcast system, named Vehicle Information and Communication System ("VICS") Center, is used in Japan. Traffic and road condition information can also be transmitted using other protocols, such as Traffic Experts Protocol Group (TPEG) and on other broadcast bearers including Digital Audio Broadcasting ("DAB"), Digital Multimedia Broadcasting ("DMB"), Hybrid Digital Radio ("HD Radio"), Digital Radio Mondiale (DRM), satellite radio, and other protocols and radio systems, such as MSN-Direct.

In these systems, the traffic data messages conform to one or more pre-established specifications or formats. The traffic message receivers decode the traffic data messages using these pre-established specifications or formats. Once decoded, the traffic information may be presented to a user.

Although traffic broadcast systems provide many important features, there continues a need for new features and improvements. The collection, processing and transmission of traffic information are costly. One area for improvement is the efficiency of the transmission of the traffic messages. Because systems broadcast traffic data over channels on a continuous, periodic or frequently occurring basis, considerable broadcast resources and bandwidth are used. Thus, there is a need to accurately and efficiently compress the traffic messages for broadcast.

SUMMARY OF THE INVENTION

To address these and other objectives, the present invention comprises a method for of compressing a plurality of TPEG format traffic messages for a geographic region. The method comprises receiving the plurality of TPEG format traffic messages, each message comprising a plurality of fields of a message management container, an event container and a location container. The method identifies fields of the message management container, the event container and the location container of the TPEG format traffic messages that have identical data values for at least two of the TPEG format traffic messages and forms a template containing the data values of the identified fields of a message management container, an event container and a location container. The method forms a global data set representing a base time of the traffic messages and data indicating the geographic region. Compressed TPEG traffic messages are created comprising a template identification indicating the template and fields of the message management container, the event container and the location container not included in the template or global data set.

According to another aspect, the present invention comprises a system for generating a plurality of traffic messages. The system comprises a computer, a database containing a plurality of traffic messages stored on a computer readable storage medium, and a compression program executed on the computer. Each traffic message comprises a plurality of fields having data values that represent a traffic event and a location of the traffic event. The compression program identifies the fields that have identical data values for two of the traffic messages, forms a template comprising the identified fields with the respective identical data values and creates a plurality of compressed traffic messages comprising a template identification indicating the template and data values of the fields not included in the template.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE DRAWINGS

An exemplary embodiment of the present invention is described herein with reference to the following drawings.

FIGS. 5*a*, 5*b* and 5*c* depict data included in several TPEG-TEC traffic messages, according to an example;

FIG. 7 depict data included in several compressed TPEG traffic messages, according to an example.

DETAILED DESCRIPTION OF THE PRESENTLY PREFERRED EMBODIMENTS

I. Traffic Broadcast System Overview

Figure 1:
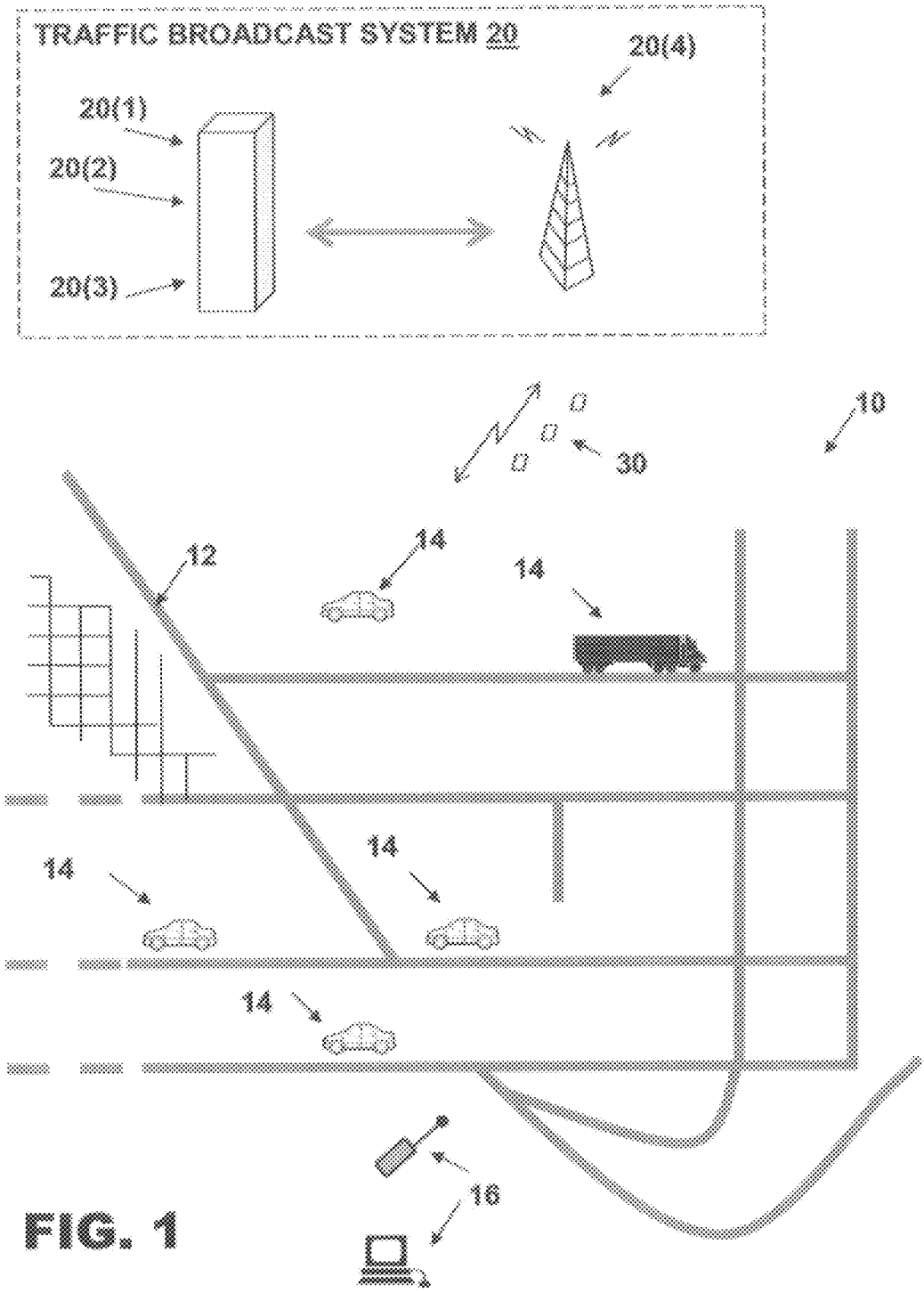
FIG. 1 is diagram illustrating components of a traffic broadcast system in a geographic region, according to an example.

FIG. 1 is diagram illustrating a region 10. The region 10 may be a metropolitan area, such as the New York metropolitan area, the Los Angeles metropolitan area, or any other metropolitan area. Alternatively, the region 10 may be a state, province, or country, such as California, Ill., France, England, or Germany. Alternatively, the geographic region 10 can be a combination of one or more metropolitan areas, states, countries, and so on. Located in the region 10 is a road network 12.

A traffic broadcast system 20 is also located in the region 10. The traffic broadcast system 20 broadcasts data 30 regarding traffic and road conditions in the region 10, sometimes referred to as traffic messages. The traffic broadcast system 20 may be operated by a governmental organization or may be privately operated. The traffic broadcasting system 20 conforms to a traffic message channel protocol, such as TMC or TPEG, carried over RDS, RBDS, VICS, DAB, DMB, DRM, HD Radio, and so on.

Vehicles 14 travel on the road network 12 in the region 10. The vehicles 14 may include a variety of cars, trucks, and motorcycles. Some or all of the vehicles 14 include suitable equipment that enables them to receive the data 30 broadcast by the traffic broadcast system 20.

The data 30 broadcast from the traffic broadcast system 20 may also be received and used in systems 16 that are not installed in vehicles (referred to herein as "non-vehicle systems"). These non-vehicle systems 16 may include workstations, personal computers, personal digital assistants, networks, pagers, televisions, radio receivers, mobile telephones, and so on. The non-vehicle systems 16 may receive the data 30 in the same manner as the vehicles, i.e., by broadcast over a traffic message channel. Alternatively, the non-vehicle systems 16 may receive the data 30 by other means, such as over telephone lines, over wireless communication networks, over the Internet, via cable, and so on. The systems in the vehicles 14 and the non-vehicle systems 16 that receive the data 30 may include various different computing platforms.

Figure 2:
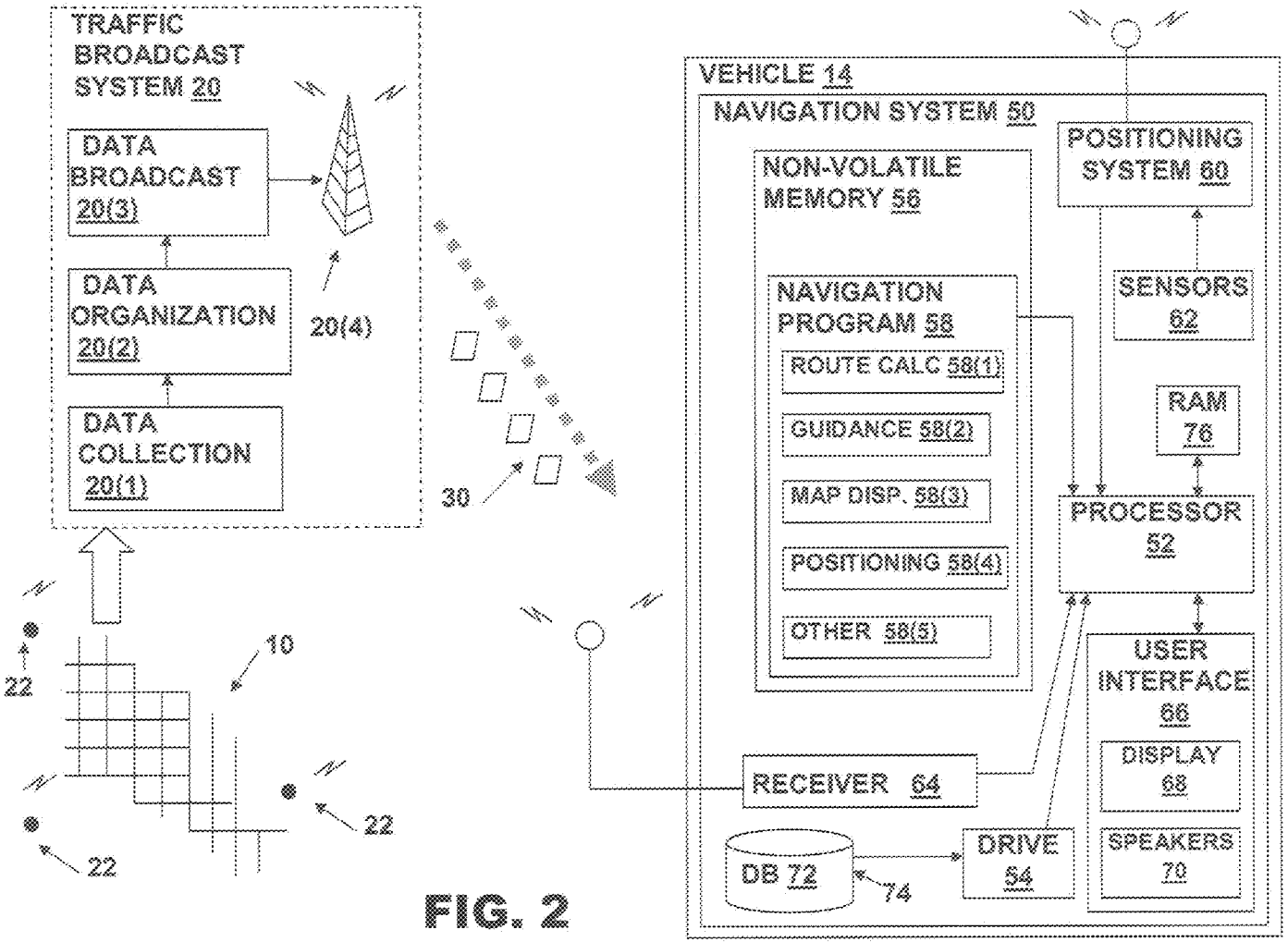
FIG. 2 is a block diagram illustrating components of the traffic broadcast system and one of the vehicles with an on-board navigation system, as shown in FIG. 1, according to an example.

FIG. 2 shows the components of the traffic broadcast system 20 and one of the vehicles 14 shown in FIG. 1. The traffic broadcast system 20 provides for the collection of data relating to traffic and road conditions, the analysis and organization of these collected data, the formatting of the analyzed data into traffic messages, and the transmission of these traffic messages to the vehicles 14 in the region 10 on a regular and continuing basis.

The traffic broadcast system 20 uses various means 22 to obtain information about traffic and road conditions. These means 22 may include sensors located in or near the roads in the road network 12, aerial sensors, sensors in vehicles 14, radar, as well as other technologies. Additionally, the traffic broadcast system 20 may use historic traffic data and models designed to predict traffic conditions.

The traffic broadcast system 20 includes equipment and programming 20(1) for collecting the data relating to traffic and road conditions in the region 10 from the various sensors 22. This equipment and programming 20(1) includes, for example, a computer, various communications links (including wireless links), receivers, data storage devices, programming executed on the computer that saves the collected data, programming executed on the computer that logs data collection times and locations, and so on.

The traffic broadcast system 20 also includes equipment and programming 20(2) for assembling, organizing, analyzing, and formatting the collected traffic and road condition data. This programming and equipment 20(2) includes a computer, computer readable storage devices, programming that statistically analyzes the collected data for potential errors, programming that organizes the collected data, programming that uses the data to prepare messages in one or more appropriate predetermined formats.

The traffic broadcast system 20 also includes suitable equipment and programming 20(3) for broadcasting the data 30. The data 30 can be the traffic and road condition data collected and organized by the traffic broadcast system 20 and/or additional data. The equipment and programming 20(3) includes a computer, computer interfaces to transmitters, programming that communicates formatted messages at regular intervals to the transmitters, and so on.

The traffic broadcast system 20 also includes transmission equipment 20(4). This equipment 20(4) may comprise one or more FM, AM, DAB, DRM, HD Radio or other transmitters, including antennas, or other wireless transmitters. This equipment 20(4) provides for broadcasting the formatted messages as data 30 throughout the region 10. The broadcasting equipment 20(4) may be part of the traffic broadcast system 20, or alternatively, the traffic broadcast system 20 may use broadcasting equipment from other types of systems, such as cellular (GSM or Global System for Mobile Communications) or paging systems, FM radio stations, and so on, to broadcast the data 30 to the vehicles 14 in the region. The broadcasting of data 30 includes any form of transmission, including direct wireless transmission.

II. Navigation System Overview

FIG. 2 also depicts the components of one of the vehicles 14 shown in FIG. 1. The vehicle 14 may be a car, a truck, a motorcycle, or any other type of vehicle in the region 10. A navigation system 50 is installed in the vehicle 14. The navigation system 50 is a combination of hardware and software components. In one embodiment, the navigation system 50 includes a processor 52, a drive 54 connected to the processor 52, and a non-volatile memory storage device 56 for storing a navigation application software program 58 and possibly other information. The processor 52 may be any type of processor suitable for navigation systems.

The navigation system 50 may also include a positioning system 60. The positioning system 60 may utilize GPS-type technology, a dead reckoning-type system, or combinations of these or other systems, all of which are known in the art. The positioning system 60 may include suitable sensing devices 62 that measure the traveling distance, speed, direction, and so on, of the vehicle 14. The positioning system 60 may also include appropriate technology to obtain a GPS signal, in a manner which is known in the art. The positioning system 60 outputs a signal to the processor 52. The signal from the positioning system 60 may be used by the navigation application software 58 that is run on the processor 52 to determine the location, direction, speed, and so on, of the vehicle 14.

The vehicle 14 includes a traffic message receiver 64. The receiver 64 receives the data 30 from the traffic broadcast system 20. For example, the receiver 64 may be an FM receiver tuned to the appropriate frequency at which the traffic broadcast system 20 is using to broadcast the data 30. As another example, when the data 30 are sent by direct wireless transmission, such as cellular wireless transmission, such as GSM, the receiver 64 in the vehicle 14 may be similar or identical to a cellular telephone. The receiver 64 provides an output to the processor 52 so that appropriate programming in the navigation system 50 can utilize the data 30 transmitted by the traffic broadcast system 20 when performing navigation functions.

Figure 3:
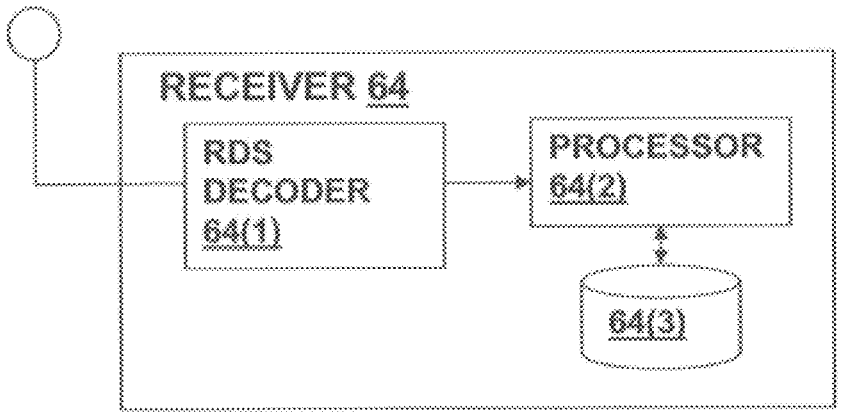
FIG. 3 is a block diagram of a receiver, as shown in FIG. 2, according to an example.

FIG. 3 is a simplified block diagram of the traffic message receiver 64 that may be used in the navigation system 50 depicted in FIG. 2. In this example, the receiver 64 is an HD Radio receiver. However, receiver design depends on the type of traffic broadcast system 20 transmitting the data 30 and, thus, the receiver 64 is not limited to any particular type of receiver. The receiver 64 includes a decoder 64(1) that receives and formats the data 30. The decoder 64(1) provides the formatted data to a processor 64(2). The processor 64(2) interprets the data and determines what action to take based on the data. For example, the processor 64(2) may read data from or write data to memory 64(3). The memory 64(3) is not limited to any memory type.

While FIG. 3 depicts the receiver 64 having its own processor 64(2) and memory 64(3), it is understood that the receiver 64 may share processing and memory with the navigation system 50 (i.e., an integrated system). For example, the receiver 64 may use the processor 52 and the non-volatile memory 56. Moreover, the receiver 64 may have additional components not depicted in FIG. 3.

Returning to FIG. 2, the navigation system 50 also includes a user interface 66. The user interface 66 includes appropriate equipment that allows the end-user (e.g., the driver or passengers) to input information into the navigation system 50. This input information may include a request to use the navigation features of the navigation system 50. For example, the input information may include a request for a route to a desired destination, such as a point of interest. The input information may also include requests for other kinds of information. The user interface equipment used to input information into the navigation system 50 may include a keypad, a keyboard, a microphone, and so on, as well as appropriate software, such as a voice recognition program. The user interface 66 also includes suitable equipment that provides information back to the end-user. This equipment may include a display 68, speakers 70, and other communication means.

The navigation system 50 uses a map database 72 stored on a computer readable storage medium 74. The storage medium 74 is installed in the drive 54 so that the map database 72 can be read and used by the navigation system 50. The storage medium 74 may be removable and replaceable so that a storage medium with an appropriate map database for the geographic region in which the vehicle is traveling can be used. In addition, the storage medium 74 may be replaceable so that the map database 72 on it can be updated easily. In one embodiment, the geographic data 72 may be a geographic database published by NAVTEQ North America, LLC of Chicago, Ill.

In one embodiment, the storage medium 74 is a CD ROM disk. In an alternative embodiment, the storage medium 74 may be a PCMCIA card in which case the drive 54 would be substituted with a PCMCIA slot. Various other storage media may be used, including fixed or hard disks, DVD disks, or other currently available storage media, as well as storage media that may be developed in the future. The storage medium 74 and the geographic database 72 do not have to be physically provided at the location of the navigation system 50. In alternative embodiments, the storage medium 74, upon which some or all of the geographic data 72 are stored, may be located remotely from the rest of the navigation system 50 and portions of the geographic data provided via a communications link, as needed.

In one type of system, the navigation application software program 58 is loaded from the non-volatile memory 56 into a Random Access Memory ("RAM") 76 associated with the processor 52 in order to operate the navigation system 50. The processor 52 also receives input from the user interface 66. The input may include a request for navigation information. The navigation system 50 uses the map database 72 stored on the storage medium 74, possibly in conjunction with the outputs from the positioning system 60 and the receiver 64, to provide various navigation features and functions.

The navigation application software program 58 may include separate applications (or subprograms) that provide these various navigation features and functions. These functions and features may include route calculation 58(1) (wherein a route to a destination identified by the end-user is determined), route guidance 58(2) (wherein detailed directions are provided for reaching a desired destination), map display 58(3), and vehicle positioning 58(4) (i.e., map matching). Other functions and programming 58(5), in addition to these, may be included in the navigation system 50. The navigation application program 58 may be written in a suitable computer programming language such as C, although other programming languages, such as C++ or Java, are also suitable.

III. TPEG Traffic Messages

Figure 4:
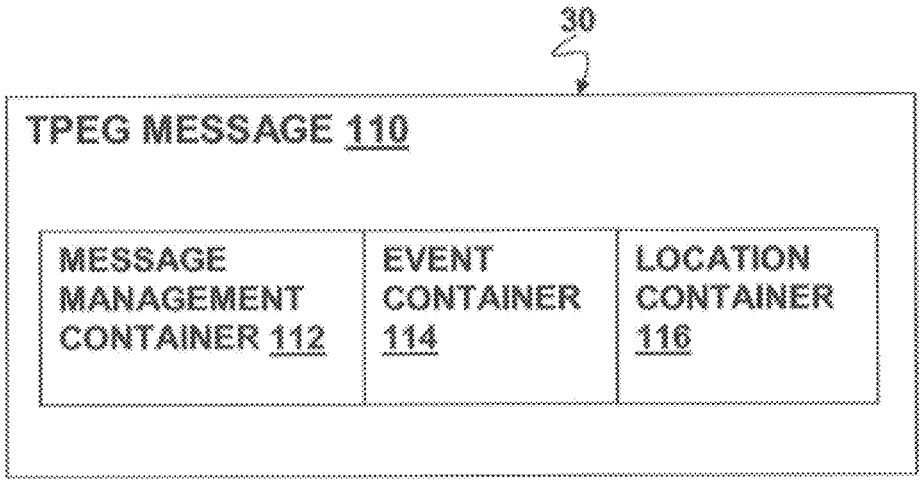
FIG. 4 is a block diagram of data included in a TPEG traffic message, according to an example.

FIG. 4 illustrates the data 30 for an example traffic message. The example traffic message is a Transport Protocol Experts Group message ("TPEG message") 110. The Transport Protocol Experts Group provides specifications for the transmission of traffic and travel information. TPEG messages may have either a binary data format designed for transmission over DAB, HD Radio and GSM or an XML implementation for delivery via the Internet. TPEG provides a framework to design different specifications for various applications including traffic information, weather information, parking information, public transport information and so on.

The example traffic message shown in FIG. 4 is a TPEG-TEC message with TEC representing Traffic Event Compact. The TPEG-TEC message 110 comprises a message management container 112, an event container 114 and a location container 116. The message management container 112 includes management information related to the overall message. The event container 114 includes traffic flow event information. The location container 116 includes location reference information for the traffic message to identify where on the road network 12 the traffic event is occurring. FIGS. 5*a*, 5*b* and 5*c* illustrate the traffic message data included in the message management container 112 (FIG. 5*a*), the event container 114 (FIG. 5*b*), and the location container 116 (FIG. 5*c*) for several TPEG-TEC messages with each row containing one TPEG-TEC message. The data represented in the FIGS. 5*a*, 5*b*, and 5*c* has a hexadecimal format.

Referring to FIG. 5*a*, the TPEG-TEC message includes a TEC service component frame 120. The service component frame comprises a header that indicates a generic component identification that defines the message as a TEC application. The header also specifies the number of bytes in the message and the length of the attribute or number of bytes to the next component identification which is the generic component identification of a header 122 of the message management container 112.

The message management container 112 of the TPEG-TEC message 110 includes the header 122 that comprises a generic component identification that defines the component as message management. The header 122 also specifies the number of bytes in the message management component and the number of bytes of the attribute or number of bytes to the next component identification. The message management container 112 contains a message number field 124 that is used to uniquely identify each traffic message. The message management container includes a version field 136 associated with each Message number field 124 which is used incrementally to track the progress of each traffic message. The message management container includes a selector field 128 which is a general parameter that provides a choice of set number of pre-established options. The message management container 112 also includes expiration time data 130 indicating the expiration time for the traffic message. After the expiration time has elapsed, the message is not guaranteed as valid. The message management container 112 includes generation time data 132 providing a date and time stamp representing the time that the message was generated. The priority field 134 of the message management container 112 indicates a relative priority of the message within the same component stream.

Referring to FIG. 5*b*, the event container 114 contains information to represent a traffic event. The event container 114 includes a header 136 that comprises a generic component identification that defines the component as traffic event data. The header 136 also specifies the number of bytes in this component and the number of bytes of the attribute or number of bytes to the next component identification. The event container 112 contains an effect code 138 that describes the impairment to the traffic flow due to the event and a selector field 140. The event container 114 also includes start time data 142 indicating the start time for the event and stop time data 144 indicating a stop time for the event.

The event container 114 also includes a second component beginning with a header 146 that comprises a generic component identification that defines the component as a direct cause component. The header 146 also specifies the number of bytes in this component and the number of bytes of the attribute or number of bytes to the next component identification. The second component includes a cause code field 148 that indicates the main cause of the traffic event, a warning level field 150, a selector field 152 and sub-cause field 154. The event container 114 includes a third component beginning with a header 156 that comprises a generic component identification that defines the component as another direct cause component. The header 156 also specifies the number of bytes in this component and the number of bytes of the attribute number of bytes to the next component identification. The third component includes cause code field 158, warning level field 160, selector field 162 and a lane restriction field 164 indicating a number of road lanes closed by the traffic event.

Referring to FIG. 5*c*, the location container 116 includes data to represent the location on the road network 12 of the traffic event. In this example, the location information is provided in a format of the Traffic Message Channel (TMC) system. For the TMC system, a unique code is pre-assigned to locations on the road network 12 within a region. In the TMC system, the location code includes a location number or TMC ID, a location table number, and a country code. The location number is a unique number within a region to which one location table (i.e., a database of numbers) corresponds. The location table number is a unique number assigned to each separate location table. The country code is a number that identifies the country in which the location referenced by the location number is located. Although the location information of the example is in the TMC format, other location referencing formats are also possible.

The location container 116 includes location reference container (LRC) header 166 that comprises a generic component identification that defines the component as a location referencing container. The header 166 also specifies the number of bytes in this component and the number of bytes of the attribute number of bytes to the next component identification. The location container 116 includes TMC location reference TLR header 168 that comprises a generic component identification that defines the component as a TMC location referencing component. The header 166 also specifies the number of bytes in this component and the number of bytes of the attribute number of bytes to the next component identification.

The location container 116 also includes a TMC ID 170 indicating a predefined location on the road network. The location container 116 also includes the country code (cc) 172, the location table number (ltn) 174 to identify the location of the traffic event. The location container 116 includes a selector (sel) 176, an extent (ext) 178 identifying a length of the traffic event by defining how many adjacent traffic locations are affected by the traffic event with the TMC ID location representing the beginning of the traffic event, and a version (ver) 180.

Although the TPEG-TEC traffic message 110 provides a format for traffic information, the TPEG-TEC traffic messages have a relatively large data size. For the example messages in FIGS. 5*a*, 5*b*, 5*c*, the data length of the messages 110 ranges from 43 bytes to 50 bytes. Because traffic broadcast systems transmit numerous traffic messages on a continuous, periodic or frequently occurring basis, considerable broadcast resources and bandwidth are consumed. Accordingly, it would be advantageous to compress the data size of the TPEG-TEC traffic messages 110.

While the TPEG-TEC message format was used in this example traffic message, it is understood that other traffic message formats can also be used for other traffic broadcasting systems. The TPEG-TEC message format will be used to describe the following compression method; however, the compression method may be readily applied to other TPEG applications as well as to other traffic message formats and to other messaging formats currently known or developed in the future.

IV. Traffic Message Compression

Figure 6:
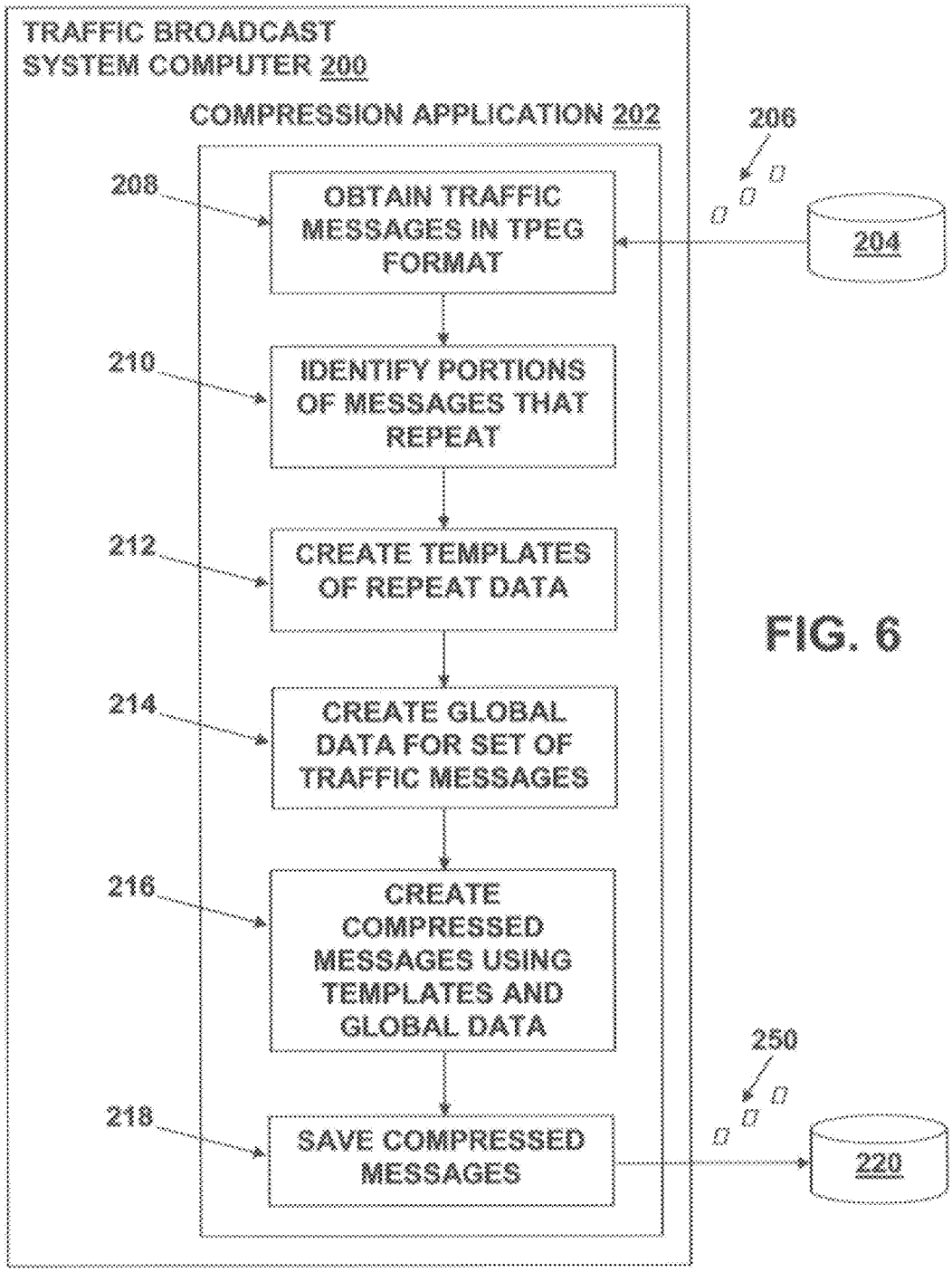
FIG. 6 is a flowchart of a method for compressing a TPEG traffic message, according to an example.

The TPEG-TEC message 110 always includes the message management container 112, event container 114 and location container 116. For numerous traffic messages, those containers have headers and other parameters that frequently contain identical data values or a small set of varying data values. Rather than transmitting the entire TPEG-TEC traffic messages 110 in their entirety which consumes considerable bandwidth and resources, the TPEG traffic message 110 may be compressed by identifying and removing the information that repeats from the individual messages. FIG. 6 illustrates a flowchart of a method for compressing the TPEG traffic messages 110 that is carried out by the traffic broadcast system 20. The compression method is implemented using the equipment and programming of the traffic broadcast system 20. As shown in FIG. 6, a traffic broadcast system computer 200 implements a compression application 202.

As discussed above in conjunction with FIG. 2, the traffic broadcast system 20 collects traffic data and organizes the traffic data into traffic messages. Referring to FIG. 6, the traffic messages 206 are stored in a traffic message database 204 on a computer readable storage medium. The traffic messages have the TPEG-TEC traffic message format discussed above in conjunction with FIGS. 5*a*, 5*b* and 5*c*. At block 208, the compression application obtains TPEG-TEC format traffic messages 206 from a traffic message database 204. At block 210, the compression application 202 identifies traffic messages and the portions of those traffic messages 206 that repeat or have fields that contain identical data values for several different traffic messages. Referring to FIGS. 5*a*, 5*b* and 5*c*, the header 120, header 122, selector 128, priority 134, header 136, selector 140, header 146, selector 152, header 156 and selector 162 have data values that are identical for several different traffic messages 206 (the third, fifth, sixth, seventh and ninth traffic message listed in the table).

At block 212, the compression application creates several templates to hold the parameters representing the repeating data values identified in block 210. For the ten TPEG-TEC messages 110 of the example in FIGS. 5*a*, 5*b* and 5*c*, the compression application creates five templates containing the data of the header 120, header 122, selector 128, priority 134, header 136, selector 140, header 146, selector 152, header 156, selector 162, header 166, header 168 and selector 176 for five of the messages. Each of the created templates is assigned a unique identification number. In another embodiment, the templates may be predefined, and the compression application matches the data of the header 120, header 122, selector 128, priority 134, header 136, selector 140, header 146, selector 152, header 156 selector 162, header 166, header 168 and selector 176 to one of the predefined templates having a unique identification number.

FIG. 7 shows an example of compressed traffic messages 250 generated by the compression application 202 from the TPEG-TEC traffic messages 110 of FIG. 5. The compressed traffic messages 250 comprise a template ID number 252 that identifies the template holding the data of the fields from header 120, header 122, selector 128, priority 134, header 136, selector 140, header 146, selector 152, header 156, selector 162, header 166, header 168 and selector 176. For template ID number 01, the template holds the data of the fields from header 120, header 122, selector 128, priority 134, header 136, selector 140, header 146, selector 152, header 156, selector 162, header 166, header 168 and selector 176 from the TPEG-TEC message of the first row in FIGS. 5*a*, 5*b* and 5*c*. The template ID number 03 holds the data of the header 120, header 122, selector 128, priority 134, header 136, selector 140, header 146, selector 152, header 156, selector 162, header 166, header 168 and selector 176 from the TPEG-TEC message of the third row in FIGS. 5*a*, 5*b* and 5*c*. Note that the template ID 03 is used to represent TPEG-TEC messages of rows 3, 5, 6, 7, and 9 because the template data for those messages are identical.

At block 214, the compression application creates global data for a set of TPEG traffic messages 110. Because the traffic system generates numerous traffic messages for a specific geographic region, the location container 116 includes data used to represent the location of the traffic incidents that is identical for several traffic messages. Additionally, the traffic system generates numerous traffic messages at the same time or having a small time difference between generation times. Accordingly, the data in each of the traffic messages typically represents similar times. Using the above insight, the compression application creates global information comprising a base time of message generation and data representing the geographic region containing the locations identified in the traffic messages. The compression application 202 gathers all of the traffic message 206 for a designated geographic region, such as for a metropolitan area or a state, province, or country. These traffic messages 206 for the designated region will have identical data in the location container 116 that will become a location portion of the global data.

Referring to FIG. 7, the compressed traffic messages 250 include compressed global information 254 generated by the compression application 202 from the TPEG-TEC traffic messages of FIG. 5. The compressed global information 254 comprises information to identify the geographic of the traffic message and time of the traffic message. The compressed global information 254 includes a base time 256 and the country code (cc) 172, the location table number (ltn) 174, version (ver) 180 from the location container 116.

At block 216, the compression application 202 creates compressed TPEG messages using the templates and global information from the set of TPEG traffic messages 110. Referring to FIG. 7, the compressed TPEG messages 250 comprise data from the original message management container 112, event container 114 and location container 116 of the TPEG-TEC messages that are not included in the templates and global information 254. Specifically, the compressed message management container 258 of the compressed TPEG messages 250 comprises the number field 124 and the version number 126 of the original TPEG-TEC messages 110. The compressed message management container 258 of the compressed TPEG message 250 also comprises a time field 260 that represents an offset from the base time 256 of the compressed global information 254. Combining the data of the time field 260 with the base time 256 provides the generation time 132 of the original TPEG-TEC messages.

The compressed event container 262 of the compress TPEG messages 250 comprises the effect code 138, the start time data 142, the stop time data 144, the cause code field 148, the warning level field 150, the sub-cause field 154, the cause code field 158, the warning level field 160, and the lanes field 164 of the original event container 114 of the original TPEG-TEC messages. The compressed location container 264 of the compressed TPEG messages 250 comprises the TMC ID 170 that identified the location of the traffic event and the extent (ext) 178 of the original location container 116 of the original TPEG-TEC messages. The compressed location container 264 of the compressed TPEG messages 250 also includes a selector (sel) 260 that indicates direction of the traffic affected by the traffic event.

At block 218 of FIG. 6, the compression application 202 saves the compressed TPEG messages 250 and compressed global information 254 with accompanying templates in a database 220 stored on a computer readable medium. The compressed TPEG messages 250 have a data size that ranges from 13 to 16 bytes and the compressed global information 254 has a data size of 7 bytes. The compression application 202 significantly reduced the data sized of the original TPEG traffic messages 206.

The compressed TPEG messages may be encrypted and/or further compressed with a ZIP compression algorithm. As discussed above in conjunction with FIGS. 1 and 2, the traffic broadcast system 20 broadcasts the compressed TPEG messages 250 to receivers 64. The receiver 64 receives and decodes the messages 250, if necessary, with the decoder 64(1). The receiver stores the messages 250 on the associated memory 64(3). Included in the broadcast of the compressed TPEG messages 250 are data representing the templates and the compressed global information 254. The compressed global information 254 may precede a grouping of compressed TPEG messages 250 or associated with certain compressed TPEG messages 250 during the broadcast. In one embodiment, the traffic system broadcasts the templates to the receivers 64. The templates may be broadcasted on a less frequent basis than the TPEG messages 250. Alternatively, the templates may be stored on memory 64(3) associated with the receiver 64 without being broadcast.

Figure 8:
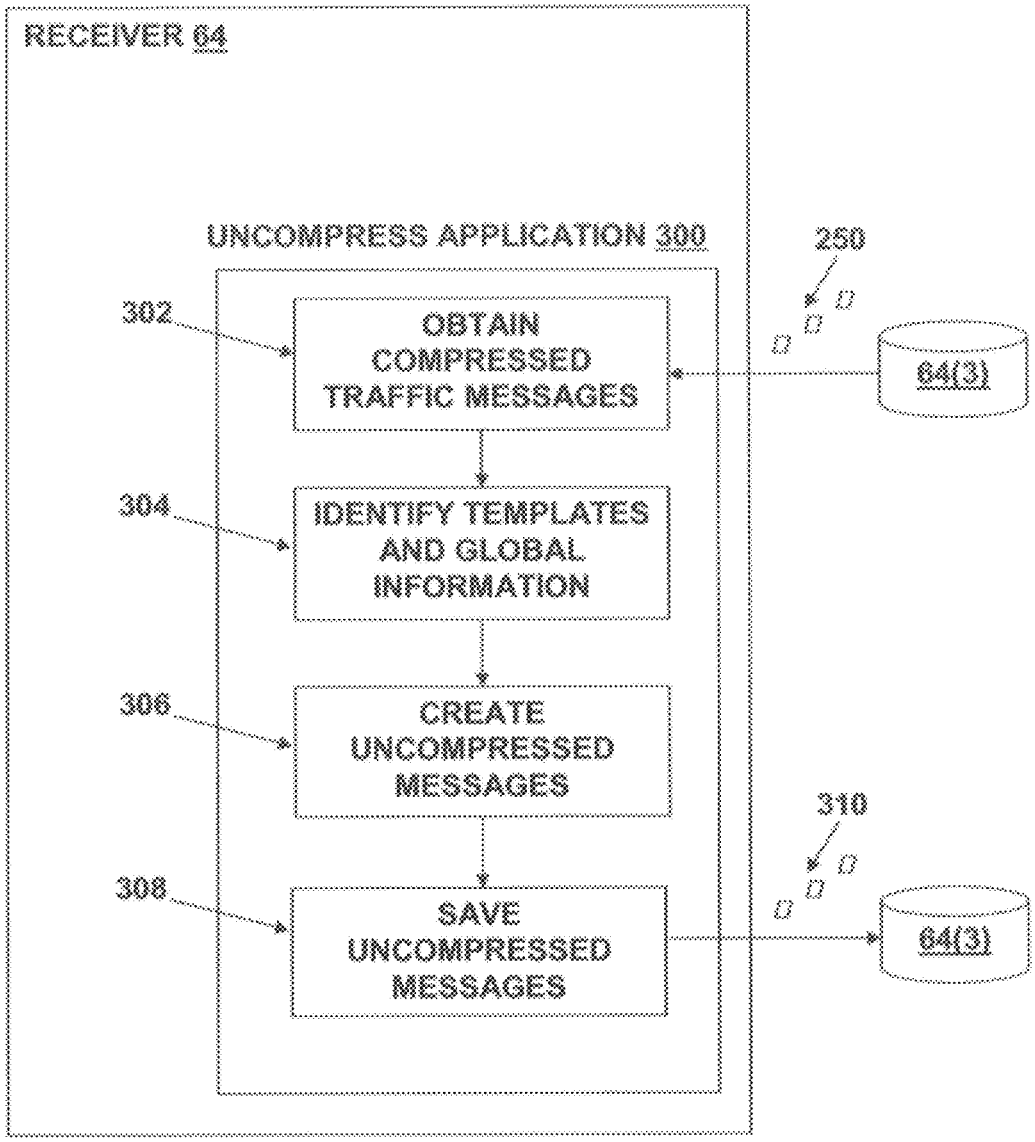
FIG. 8 is a flowchart of a method for uncompressing a compressed TPEG traffic message, according to an example.

FIG. 8 illustrates a flowchart of a method for uncompressing the compressed TPEG traffic messages 250 that is carried out by an uncompress application 300 executed by the processor 64(2) of the receiver 64. At block 302, the uncompress application 300 obtains compressed TPEG traffic messages 250 from the memory 64(3). Alternatively, the uncompress application 300 may obtain the compressed TPEG traffic messages 250 directly from the decoder 64(1). At block 304, the uncompress application 300 identifies the templates and global information 254 associated with a set of the compressed TPEG traffic messages 250. The uncompress application 300 uses the template ID 252 of the compressed TPEG messages 250 to obtain the needed templates from memory 64(3). The uncompress application 300 obtains the global information 254 associated with the with the compressed TPEG messages 250 when retrieving the messages 250 from memory 64(3) or directly from the broadcast data stream.

At step 306, the uncompress application 300 reconstructs the original TPEG-TEC messages 110 from the compressed TPEG messages 250, global information 252 and templates. The message management container 112 is reconstructed using the data from the designated template including the header 120, header 122, selector 128, expiration time and priority 134 as well as data from the compressed TPEG message 250 of the number 124, version 126. The generation time 132 is obtained from the base time 256 of the global information 254.

The event container 114 is reconstructed using the data from the designated template including the fields of header 136, selector 140, header 146, selector 152, header 156 and selector 162 as well as data from the compressed TPEG message 250 of the effect code 138, start time 142, stop time 144, cause code 148, warning level 150, sub-cause 154, cause code 158, warning level 160 and lanes 164. The location container 112 is reconstructed using the data from the designated template including the LRC header 166, TLR header 168 as data from the global information 254 of country code 172, location table number 174, and version 180 well as data from the compressed TPEG message 250 of the TMC ID 170, extent 178 and selector 266.

At block 308, the uncompress application 300 stores the restored TPEG-TEC traffic messages 310 in the memory 64(3). The restored TPEG-TEC traffic messages 310 may then be used by the navigation system 50 when providing navigation features and functions including route calculation, route guidance, and map display. Additionally, the traffic information may be provided to the user via the display 68 and/or speakers 70.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A computer implemented method of generating a plurality of traffic messages, the method comprising:

receiving a plurality of TPEG format traffic messages, each message comprising a message management container, an event container and a location container, the message management container includes a plurality of fields having data values that represent management information for the traffic message, the event container includes a plurality of fields having data values that represent a traffic event, and the location container includes a plurality of fields having data values that represent a location of the traffic event;

identifying fields of the message management container that have identical data values for two of the traffic messages;

identifying fields of the event container that have identical data values for the two of the traffic messages;

identifying fields of the location container that have identical data values for the two of the traffic messages;

forming a template comprising the identified fields of the message management container with the respective data values, the identified fields of the event container with the respective data values and the identified fields of the locations container with the respective data values;

forming a global data set representing a base time of the traffic messages and a geographic region in which the traffic events are located;

creating a plurality of compressed TPEG format traffic messages comprising a template identification indicating the template and data values of fields of the message management container, data values of the fields of the event container and the location container not included in the template; and storing the compressed TPEG format traffic messages, the template and the global data set on a computer readable storage medium.

2. The method of claim 1 further comprising:

transmitting the compressed TPEG format traffic messages, the template and the global data set to a plurality of navigation systems.

3. The method of claim 2 further comprising:

receiving the compressed TPEG format traffic messages, the template and the global data set; and creating uncompressed TPEG format traffic messages using the compressed TPEG format traffic messages and the data values from the template and the global data set.

4. The method of claim 1 wherein the message management container comprising a generation time field indicating a time that the TPEG format traffic message was created.

5. The method of claim 4 wherein the compressed TPEG format traffic message includes the generation time field with a data value representing a time offset from the base time of the global data set.

6. The method of claim 1 wherein the template includes header fields with data values for the message management container, header fields with data values for the event container and header fields with data values for the location container.

7. The method of claim 1 wherein the template includes selector fields with data values for the message management container, selector fields with data values for the event container and selector fields with data values for the location container.

8. A computer implemented method of generating a plurality of traffic messages, the method comprising:

receiving a plurality of traffic messages, each message comprising a plurality of fields having data values that represent a traffic event a location of the traffic event;

identifying the fields that have identical data values for two of the traffic messages;

forming a template comprising the identified fields with the respective identical data values;

creating a plurality of compressed traffic messages comprising a template identification indicating the template and data values of the fields not included in the template; and storing the compressed traffic messages and the template on a computer readable storage medium.

9. The method of claim 8 further comprising:

transmitting the compressed traffic messages and the template to a plurality of navigation systems.

10. The method of claim 9 further comprising:

receiving the compressed traffic messages and the template; and uncompressing the compressed traffic messages using data values from the template.

11. The method of claim 8 wherein the template includes header fields with data values.

12. The method of claim 8 wherein the template includes a field representing a base time of the traffic messages.

13. The method of claim 12 wherein the compressed traffic message a time field with a data value representing a time offset from the base time of the template.

14. The method of claim 8 wherein the template includes a field representing a geographic region in which the traffic events are located.

15. The method of claim 8 wherein the compressed traffic messages have a smaller data size than the traffic messages.

16. A system for generating a plurality of traffic messages, the system comprising:

a computer;

a database containing a plurality of traffic messages stored on a computer readable storage medium, each traffic message comprising a plurality of fields having data values that represent a traffic event and a location of the traffic event; and a compression program executed on the computer, the compression program identifies the fields that have identical data values for two of the traffic messages, forms a template comprising the identified fields with the respective identical data values and creates a plurality of compressed traffic messages comprising a template identification indicating the template and data values of the fields not included in the template.

17. The system of claim 16 further comprising:

a transmitter for sending the compressed traffic messages and the template to a plurality of navigation systems.

18. The system of claim 16 wherein the template includes header fields with data values.

19. The system of claim 16 wherein the template includes a field representing a base time of the traffic messages.

20. The system of claim 16 wherein the template includes a field representing a geographic region in which the traffic events are located.

* * * * *